US006695527B2

(12) United States Patent
Seaux et al.

(10) Patent No.: US 6,695,527 B2
(45) Date of Patent: Feb. 24, 2004

(54) INTERLOCKING MAT SYSTEM FOR CONSTRUCTION OF LOAD SUPPORTING SURFACES

(75) Inventors: Ores Paul Seaux, Carencro, LA (US); Kenneth P. Seaux, Church Point, LA (US); Donald S. Rogers, Lafayette, LA (US)

(73) Assignee: OLS Consulting Services, Inc., Lafayette, LA (US)

( * ) Notice: Subject to any disclaimer, the term of this patent is extended or adjusted under 35 U.S.C. 154(b) by 0 days.

(21) Appl. No.: 10/351,807

(22) Filed: Jan. 27, 2003

(65) Prior Publication Data

US 2003/0113162 A1 Jun. 19, 2003

Related U.S. Application Data

(63) Continuation of application No. 09/585,253, filed on May 31, 2000, now Pat. No. 6,511,257.

(51) Int. Cl.[7] ..... E01C 5/18

(52) U.S. Cl. ..... 404/34; 404/35; 404/44; 404/41; 428/116; 428/117

(58) Field of Search ..... 404/34, 35, 44, 404/41; 428/116, 117

(56) References Cited

U.S. PATENT DOCUMENTS

| | | | | |
|---|---|---|---|---|
| 379,027 A | | 3/1888 | Pickering | |
| 3,616,111 A | | 10/1971 | Raech | |
| 4,629,358 A | | 12/1986 | Springston et al. | |
| 4,801,483 A | * | 1/1989 | Beckerman et al. | 428/71 |
| 5,139,845 A | | 8/1992 | Beckerman et al. | |
| 5,405,567 A | * | 4/1995 | Needham et al. | 264/322 |
| 5,653,551 A | | 8/1997 | Seaux | |
| 5,667,866 A | * | 9/1997 | Reese, Jr. | 428/116 |
| 5,776,582 A | | 7/1998 | Needham | |
| 5,807,021 A | | 9/1998 | Aaron | |
| 5,888,612 A | | 3/1999 | Needham et al. | |
| 6,253,530 B1 | | 7/2001 | Price et al. | |
| 2002/0192024 A1 | * | 12/2002 | Webster et al. | 404/41 |

OTHER PUBLICATIONS

International Search Report Aug. 28, 2001.

* cited by examiner

*Primary Examiner*—Gary S. Hartmann
*Assistant Examiner*—Katherine Mitchell
(74) *Attorney, Agent, or Firm*—Ted M. Anthony

(57) ABSTRACT

A reusable mat system for the construction of load bearing surfaces, such as temporary roadways and equipment support surfaces, over unstable or unsubstantial terrain, comprising durable, interlocking individual mats which can be quickly and easily installed in a single application, and which can thereafter be easily removed and stored until needed again. The individual mats of the present invention interlock on all sides to form stable and continuous load bearing surfaces, and exhibit favorable traction characteristics.

8 Claims, 6 Drawing Sheets

INTERLOCKING MAT SYSTEM FOR CONSTRUCTION OF LOAD SUPPORTING SURFACES

CROSS REFERENCES TO RELATED APPLICATIONS

This is a continuation of application Ser. No. 09/585,253, filed May 31, 2000, now continuation of U.S. Pat. No. 6,511,257 B1, issued Jan 28, 2003.

STATEMENTS AS TO RIGHTS TO INVENTIONS MADE UNDER FEDERALLY-SPONSORED RESEARCH AND DEVELOPMENT (Not Applicable)

BACKGROUND OF THE INVENTION

1. Field of the Invention

The present invention relates to a reusable mat system for the construction of load bearing surfaces, such as temporary roadways and equipment support surfaces, over unstable or unsubstantial terrain. More particularly, the present invention relates to a reusable system of durable, interlocking individual mats which can be quickly and easily installed in a single application to construct temporary roadways and equipment support surfaces, and which can thereafter be easily removed and stored until needed again. More particularly still, the present invention relates to a reusable mat system comprising generally identical mats constructed of thermoplastic resins or other moldable materials, which interlock on all sides to form stable and continuous load bearing surfaces, and which exhibit favorable traction characteristics.

2. Description of the Related Art

When performing operations with heavy equipment in a remote location, it is often necessary to provide a firm, stable and continuous surface to support such heavy equipment. For example, when drilling a well in a remote location, it is often necessary to provide work surfaces used during the drilling process. It is also advantageous to provide one or more roadways to permit ingress to and egress from said remote location. Such a surface must provide sufficient support for the equipment and personnel involved in the work process, and must be able to withstand severe weather. Further, such a support surface must be capable of being quickly and easily installed, and thereafter being easily removed and reused at other locations.

Wooden boards or planks have historically been used to construct temporary roadways and equipment support surfaces in remote or undeveloped areas where the terrain lacks sufficient integrity to adequately support trucks and other heavy equipment. Such boards were generally placed end to end, or side by side, to form a continuous load supporting surface. While individual wooden boards or planks have been used to construct support surfaces for some time, this method of building roadways and other load bearing surfaces suffers from some very significant disadvantages.

Because such a large number of individual wooden boards are generally required to construct a typical roadway or equipment support surface, the use of wooden boards can be very labor intensive, since each board must first be individually positioned, and thereafter nailed or otherwise secured in place. Removal of said individual boards can also be a very time consuming and labor intensive process, since each board must be separated or pulled apart prior to being removed from the location. Each individual board must also be loaded onto a truck or other means of transportation prior to being removed from the particular location or work site.

In order to overcome the aforementioned shortcomings associated with the use of individual boards, a variety of mat systems have been developed for the construction of temporary roadways and support surfaces. These mat systems typically utilize prefabricated, multi-layered wooden mats which can be installed in a variety of configurations to create roadways or other support surfaces. These mats, which are constructed of a number of individual boards or planks affixed together in a variety of configurations, generally interconnect or inter mesh with one another to form a continuous, or nearly continuous, support surface.

While such conventional mat systems may represent an improvement over the use of individual boards for the construction of roadways and other equipment support surfaces, the aforementioned conventional mat systems suffer from a number of serious shortcomings. Although such conventional mats may reduce labor requirements compared to individual wooden boards, significant amounts of time, effort and manpower are still required to install said mats at a remote location since most, if not all, of said conventional mat systems require the use of multiple layers. In other words, an initial layer must first be installed, then at least one additional layer of mats must be installed over said first layer. This multiple layer requirement leads to significant redundancy of effort in connection with both the installation and removal of said mats.

Additionally, the design of conventional mat systems can lead to degradation of the ground underlying said mats, as well as the structural integrity of the mats themselves. Because the individual mats of conventional mat systems are generally constructed of various configurations of wooden boards or planks, conventional mats contain gaps or seams between said boards and/or planks. As rain falls on said mats, the rain water passes through the seams of said mats and mixes with the underlying soil to make mud. Trucks and other heavy equipment passing over the mats place a downward load on said mats, which in turn causes mud to be pumped up through the numerous gaps or seams of the mats. This pumping action creates voids beneath the mats which, over time, can lead to severe deformities in the roadway surface. Because the mats bridge over these underlying voids, the mats thereafter have a tendency to break or splinter when subjected to loading from above, especially after such wooden mats dry out.

Conventional wooden mats also suffer from significant rotting problems, since the mats can become inundated with rain water and various other contaminants from above, as well as mud from below. This mixture of water, mud and other contaminants will often invade into the seams or gaps between the boards of said mats, causing the wooden mats to rot from within. As a result, just as with individual boards, conventional mats must be frequently repaired and, in some cases, entirely replaced. Although conventional mat systems are designed to be reusable, the mats are still subject to significant repair and replacement expense. The design of these conventional mats can also lead to significant environmental problems, because mud and other contaminants can saturate the mats and collect within the numerous seams or gaps of said mats.

Yet another shortcoming with existing mat systems is the failure of individual mats to lock or interconnect with one another on all sides. Because the intended use of the mats dictates that the roadway or support surface will be subjected to loading from heavy equipment, often in different lateral directions, it is advantageous for individual mats to interconnect on all sides. This will prevent the individual mats from separating or "walking apart" from one another, and will promote a continuous and uniform work surface.

Mat systems have been known in the art for some time. U.S. Pat. No. 2,819,026 to Leyendecker, describes a mat system wherein individual mats interconnect on two sides, and which further requires the use of a strap means for retaining said mats in a desired position.

U.S. Pat. No. 4,462,712 to Penland describes a mat system comprised of individual mats which contain interlocking fingers and recesses, but which interlock on only two sides. Similarly, U.S. Pat. No. 5,087,149 to Waller and U.S. Pat. No. 4,600,336 to Waller also disclose mat systems employing individual mats with alternating offset extensions and recesses along the edges of said individual mats. However, said patents describe offset extensions comprised of individual planks which are subject to warpage, cracking or splintering when exposed to environmental elements, as well as loading from trucks or other heavy equipment using the work surface. Moreover, unlike the present invention, these offset extensions often need to be nailed in place to be secured within the recess of an adjacent mat. The referenced patents to Waller also describe the additional step of securing a plank or board between the individual mats, which significantly increases labor requirements associated with these mat systems.

U.S. Pat. No. 5,273,373 to Pouyer; U.S. Pat. No. 5,316,408 to Stanley, et al.; U.S. Pat. No. 4,875,800 to Hicks and U.S. Pat. No. 4,973,193 to Watson et al. all describe mat systems which are installed in multiple layers or stages. This factor makes the installation process significantly more complicated than that of the present invention, and greatly increases labor costs associated with said installation.

U.S. Pat. No. 4,629,358 to Springston discloses a mat system for the construction and repair of airfield surfaces. The individual mats described in the '358 patent are fiberglass—reinforced plastic composite mats which include hollow inorganic silica spheres for weight reduction purposes. Although the mats disclosed in the '358 patent exhibit a generally similar outer configuration to the mats of the present invention, the mats described in the '358 patent do not contain integral internal cellular structure. Moreover, the airfield mats of the '358 patent, unlike the preferred embodiment of the mats of the present invention, are not constructed of two mirror-image panels or half-mats which are joined together to form a complete single mat.

U.S. Pat. No. 5,653,551 to Seaux also describes a mat system for the construction of roadways and equipment support surfaces comprised of individual mats containing internal cellular structure. However, the mats disclosed in the '551 patent do not include traction promoting elements in the form of raised strips extending outward from the planar surfaces of the individual mats. More significantly, the '551 patent does not disclose the placement of such raised strips proximate to, and in general alignment with, the internal cell forming walls of the individual mats. In addition, the mats disclosed in the '551 patent contain offset peripheral edges, but lack means for mechanically affixing said mats to adjacent mats.

U.S. Pat. No. 5,888,612 to Needham, et al, discloses load bearing structures which can be molded from thermoplastic resin, and which have internal cellular structure. However, the individual mats described in the '612 patent have a dramatically different outer configuration than the mats of the present invention. Further, the mats described in the '612 patent also lack traction promoting elements on the outer planar surfaces of said mats, as well as means for mechanically joining said mats to other adjoining mats.

The prior art in general, and the aforementioned patents in particular, fail to disclose a mat system having the advantages of the invention disclosed herein.

SUMMARY OF THE INVENTION

The mat system of the present invention is a durable, reusable mat system which can be utilized to construct roadways and other support surfaces. Moreover, the mat system of the present invention can be horizontally expanded in all lateral and longitudinal directions to provide the desired coverage by the roadway or other support surface being constructed. Due to the generally uniform outward configuration of the individual mats of the present invention, a roadway and/or other support surface can be installed in a single layer by simple placement of the individual mats. Additionally, this generally uniform outward configuration allows for great flexibility in the installation process. These qualities greatly reduce the time, expense and labor requirements associated with installing and removing the disclosed invention.

The mat system of the present invention further comprises individual mats which are impermeable, so that fluids cannot seep through said mats. For this reason, the pumping effect observed with other conventional mats is effectively eliminated, and deterioration of the underlying terrain is thereby greatly reduced. The individual mats of the mat system of the present invention are also lighter than mats of most conventional mat systems, which allows for more efficient and economical transportation of said mats to and from installation locations.

Because the mats of the present invention possess substantially continuous outer surfaces, there are no gaps or channels in which mud and other contaminants can accumulate. Further, the mats of the present invention can be easily washed to remove any mud or other contaminants which may adhere to the outer surfaces of said mats. These qualities prevent the spread of contaminants from one installation location to another.

The dimensions of the individual mats of the present invention can be varied to fit particular uses and/or applications. In the preferred embodiment, the lateral dimensions of the individual mats of the present invention are approximately eight (8) feet wide by fourteen (14) feet long. Again, it must be stressed that these dimensions are not a limitation; the dimensions of the individual mats of the present invention can be changed as necessary to fit a particular application. As such, although it is generally beneficial for all individual mats of the mat system of the present invention to be roughly the same size as one another, it may be desirable to have a number of mats of different dimensions to customize the shape of a work surface or permit placement of mats where space may be limited.

Traction promoting elements are provided on the planar surfaces of the individual mats of the present invention. Said traction promoting elements are utilized to improve frictional characteristics of said mats, thereby improving traction for vehicles and other equipment traveling across roadways and other support surfaces constructed from the mat system of the present invention. Ideally, said traction promoting elements are raised members extending outward from the planar surfaces of the individual mats of the invention described herein. A large number of said raised members are beneficially positioned proximate to, and in general alignment with, the cell walls defining the internal cellular structure of said individual mats. In the preferred embodiment, wherein the cellular structure of the individual mats is in the shape of a plurality of hexagonal honeycombs, said traction promoting elements are corresponding in the form of raised strips extending outward from the planar surfaces of the individual mats of the present invention, and defining a plurality of generally star-like patterns on said planar surfaces.

When significant weight is placed on the individual mats of the present invention, such as when said mats are subjected to downward loading from trucks or other heavy equipment, said raised traction promoting elements are likewise subjected to heavy loading. Because said traction promoting elements represent substantially less surface area than the planar surfaces of said individual mats, such loading will tend to be focused or concentrated on said traction promoting elements. When such raised members are positioned proximate to, and in alignment with, the internal cell forming walls of the individual mats, said cell forming walls provide direct support for loading. However, when a large number of such raised members are not positioned in such a manner, the relatively thin outer skin defining the roughly planar surfaces of the mats can become easily deformed by such direct loading.

In addition to said traction promoting raised elements, the preferred embodiment of the mats of the present invention also include traction promoting anti-skid planar surfaces. Such anti-skid surfaces can be affixed to the mats or molded into said mats by overmolding a thin layer of traction promoting material on the work surface of said mats. In the preferred embodiment, said mats are molded primarily of thermoplastic resin. During the molding process, a relatively thin surface layer of low density material is overmolded across the bulk thermoplastic resin. Although any number of materials can be contemplated for this purposes, low density polyethylene ("LDPE") or very low density polyethylene ("VLDPE") can be used for this purpose in the preferred embodiment. Said low density material exhibits a greater coefficient of friction than the bulk resin used to mold the mats, which in turn promotes the anti-skid quality of said surface layer. Further, to the extent that said mats are molded out of thermoplastic resin, any number of additives can be included within the mats to meet or otherwise improve desired characteristics. For example, in the preferred embodiment, it may be beneficial to include one or more additives to control the static electricity characteristics of the mats.

In the preferred embodiment of the present invention, the individual mats are constructed of two mirror-image half-pieces which are joined together to form a complete single mat. Said half-pieces are comprised of at least one area of reduced material consisting of a planar skin having cell forming walls which extend outward in roughly perpendicular fashion from said planar skin and which define open faced cellular structure. Each of said half-pieces also have two adjacent edge areas without exposed cellular structure that exhibit characteristics similar to solid structure; that is, said adjacent edges have roughly continuous outer surfaces on all sides. In order to form a single mat, two mirror-image half-pieces are affixed together, such that the areas of said half-pieces which exhibit open-faced cellular structure are aligned with, and directly adjacent to, one another.

The half-pieces of the present invention can be affixed together by a variety of means. For example, said half-pieces can be welded or glued together to form a complete mat. Such welding can be performed across the opposing surfaces of the half-pieces, or along the peripheral seam between said half-pieces. Additionally, mechanical fasteners such as screws and nuts, or rivets, can be used to join said half-pieces to one another. Furthermore, various combinations of such joining methods can be employed to affix said half-pieces to one another. In the preferred embodiment, a combination of mechanical fasteners and peripheral welding is used to affix said mirror-image half-pieces to one another to form a single, complete mat.

Additionally, it is desirable to utilize a plurality of rigid inserts between the mirror-image half-pieces of the present invention. Such inserts are beneficially shaped to fit within corresponding opposing cells of two half-pieces which are joined together to form a complete mat. In the preferred embodiment, such inserts are generally hexagonal in shape to correspond to the hexagonal shaped open-faced cells of the half-pieces of the present invention.

When the mats of the present invention are used to construct a roadway or support surface, particularly in a remote location, it is not uncommon for said mats to be exposed to large temperature changes. Often, one planar surface of a mat will be exposed to direct sunlight, while the opposite planar surface will be face down and therefore obscured from such sunlight. As a result, although two half-pieces are permanently affixed to form a single complete mat, a temperature differential can nonetheless exist between such half-pieces. This temperature variance can result in a differential in shrinkage rates between said half-pieces which can, in turn, generate forces which cause said half-pieces to curl and/or pull apart from one another. Rigid inserts placed within opposing cells of two half-pieces will help to offset such forces. Such rigid inserts help keep the half-pieces aligned with one another, and help resist differential shrinkage. Further, such rigid inserts also can improve overall stiffness characteristics of said mats. In applications where greater stiffness is required, a greater number of rigid inserts can be used.

As trucks or other vehicles travel across roadways or other support surfaces constructed from the mat system disclosed herein, mats of conventional mat systems can have a tendency to pull or "walk apart" from one another. It is possible for such a roadway or other surface constructed of the mat system of the present invention to remain roughly intact and useable without means of linking said mats together. However, in the preferred embodiment, the peripheral edges of said mats contain receptacles for receiving fastening devices. Such fastening devices act to mechanically affix the mats together, and thereby prevent said mats from pulling away from one another after being installed at a remote location. Any number of different configurations of receptacles and/or fasteners can be utilized. However, in the preferred embodiment, said receptacles are spaced in a consistent manner. Along the long edge of each mat, said receptacles are spaced in a group of three near the center of said mat, while an additional receptacle is positioned near each end of said long edge. Two receptacles are also located along the short edge of each mat. Additionally, a receptacle is positioned near the corners of the mat between said long and short sides.

It is therefore an object of the present invention to provide a durable, reusable mat system which can be utilized to construct roadways or other support surfaces.

It is a further object of the present invention to provide a mat system wherein horizontal expansion of the desired roadway and/or equipment support surface is accommodated in all longitudinal and lateral directions.

It is a further object of the present invention to provide a mat system wherein the individual mats of said system are restrained from horizontal movement by frictional contact with the underlying terrain, and mechanical contact with adjoining mats.

It is a further object of the present invention to provide a mat system comprising a plurality of wholly interchangeable individual mats which can be installed in a single layer by simple relative placement.

Other and additional objects of the invention are apparent throughout the details of construction and operation as more fully described herein and illustrated in the accompanying drawings.

DESCRIPTION OF PREFERRED EMBODIMENT

Figure 1:
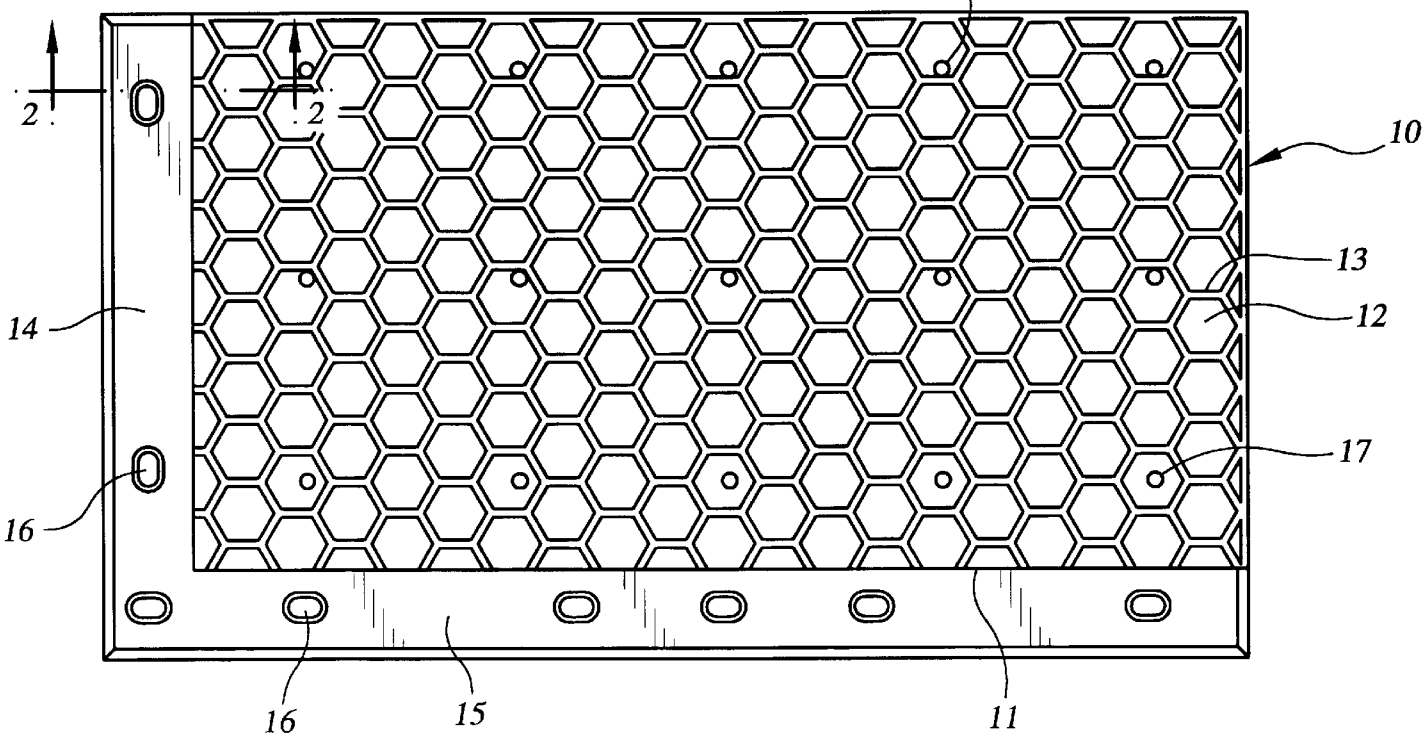
FIG. 1 depicts a top plan view of a half-piece component of an individual mat of the present invention.

In the preferred embodiment, the individual mats of the present invention are comprised of two mirror-image half-piece components which are affixed together to form a single mat. FIG. 1 depicts a half-piece component 10 of the present invention. In the preferred embodiment, an area of reduced material is in the form of open faced cellular structure, specifically a plurality of hexagonal honeycombs 12. Such open faced cellular structure is generally comprised of interconnected cell forming walls 13, which define said hexagonal honeycombs. In the preferred embodiment, said cell forming walls are integrally attached to a roughly continuous skin along one edge of said honeycombs, which in turn defines a generally planar work surface on one side of said half-piece. Two adjacent peripheral edges 14 and 15 of said half-piece 10 define areas having roughly continuous outer surfaces. Additionally, one or more recessed receptacles 16 are disposed through edges 14 and 15. A plurality of holes 17 are disposed through half-piece 10 for receiving bolts or other fastening devices.

In the preferred embodiment, half-piece 10 is joined with and permanently affixed to a mirror-image half-piece. Said half-pieces are oriented such that the areas of reduced material, that is, cellular structure, on opposing half-pieces are aligned with one another such that only such sections of reduced material overlap. This orientation results in upper peripheral extensions along two adjacent edges of a complete mat of the present invention, and lower peripheral extensions along the remaining two sides of said complete mat.

Figure 2:
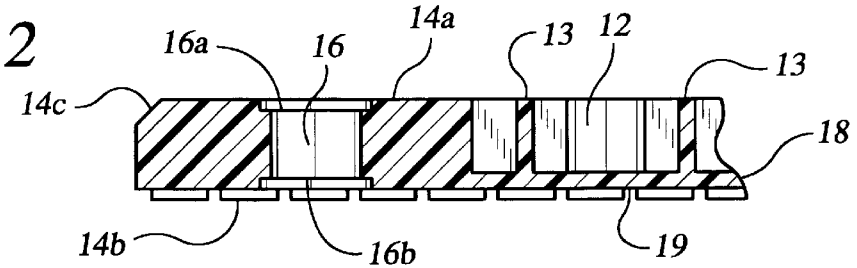
FIG. 2 depicts a cross-sectional cut-away view of a half-piece component along line 2—2 of FIG. 1.

Referring to FIG. 2, hexagonal honeycomb 12 is defined by vertical cell forming walls 13. Roughly continuous skin 18 is integrally formed along the base of honeycomb 12 to define work surface 19. Peripheral edge 14 has roughly continuous outer surfaces 14*a* and 14*b*, as well as chamfered edge 14*c*. Recessed receptacle 16 is disposed through peripheral edge 14. Recessed receptacle 16 has upper recessed ledge 16*a* and lower recessed ledge 16*b*.

Figure 4:
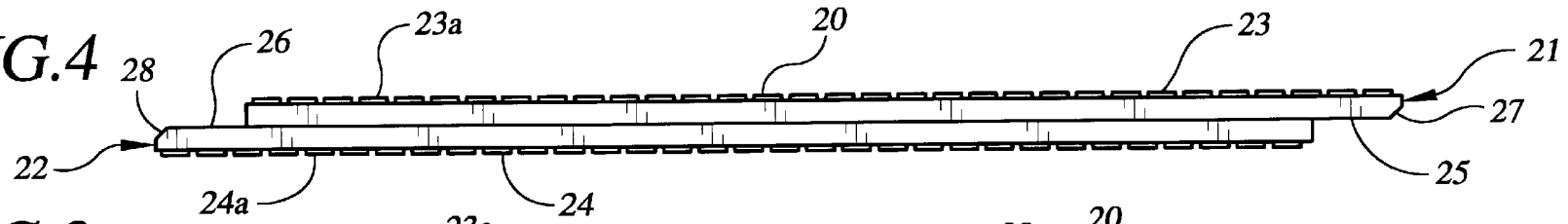
FIG. 4 depicts a side view of an individual mat of the present invention.

Referring to FIG. 4, the preferred embodiment of the mat system of the present invention comprises a plurality of generally identical individual mats such as mat 20. Mat 20 has upper stratum defined by upper half-piece 21 and a lower stratum defined by lower half-piece 22, lower half-piece 22 being roughly identical to half-piece 10 depicted in FIG. 1. Upper half-piece 21 and lower half-piece 22 of mat 20 are mirror images of one another. Upper half-piece 21 has generally planar upper work surface 23, while lower half-piece 22 has generally planar lower work surface 24. Upper half-piece 21 and lower half-piece 22 are mutually offset relative to each other, thereby resulting in upper peripheral extension 25 and lower peripheral extension 26. In the preferred embodiment, peripheral edge 27 of upper half-piece 21 and peripheral edge 28 of lower half-piece 22 are chamfered along the full extent of said half-pieces. A plurality of raised traction promoting elements 23*a* are disposed on generally planar upper work surface 23, while a plurality of raised traction promoting elements 24*a* are disposed on generally planar lower work surface 24.

Figure 3:
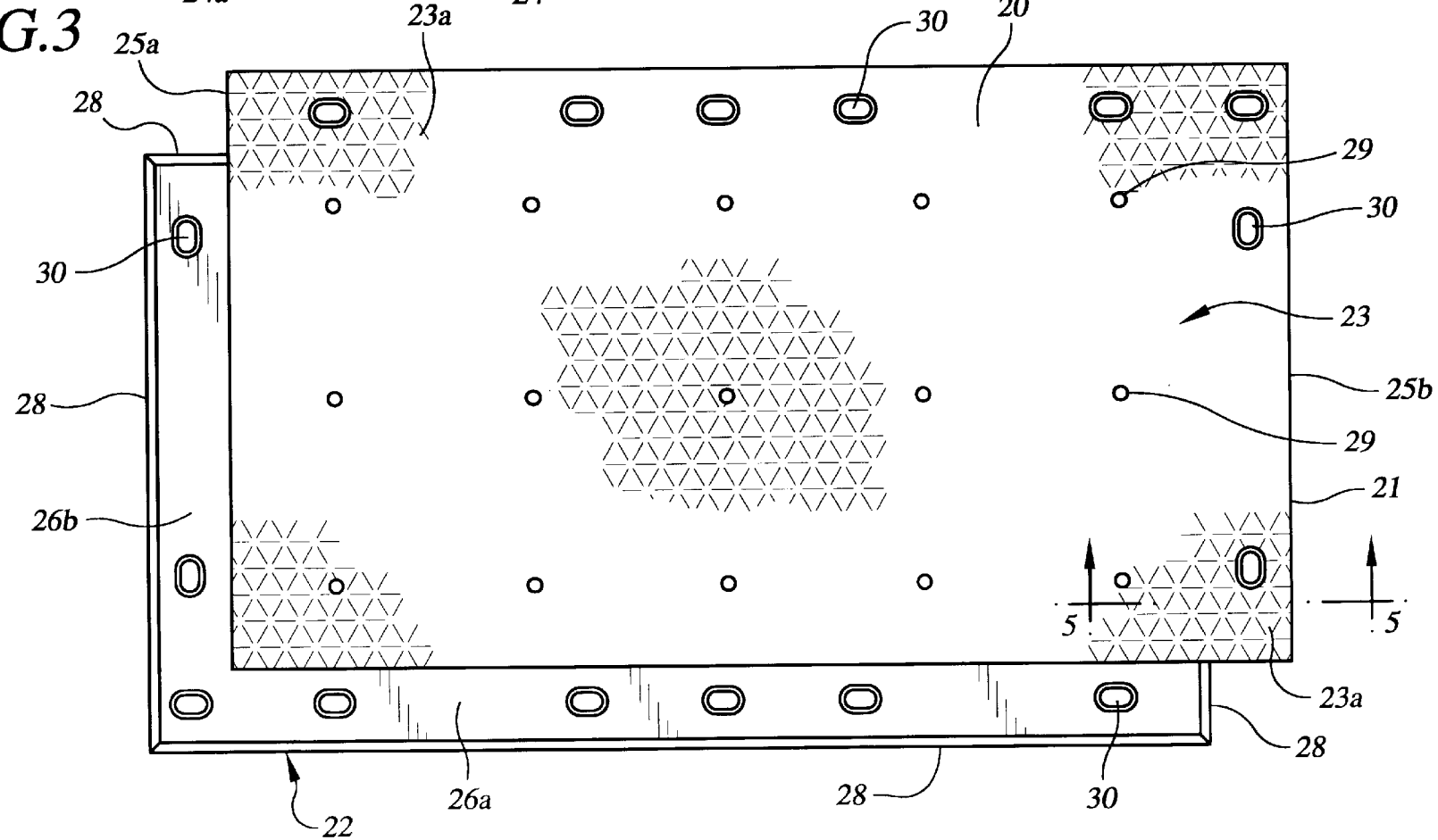
FIG. 3 depicts a top plan view of an individual mat of the present invention.

FIG. 3 depicts a top plan view of individual mat 20, having upper half-piece 21 and lower half-piece 22 permanently affixed together, thereby defining upper peripheral extensions 25*a* and 25*b* on two adjacent edges of mat 20, and lower peripheral extensions 26*a* and 26*b* on the remaining two adjacent edges of mat 20. When two individual mats of the preferred embodiment are placed together laterally for purposes of constructing a roadway or other support surface, lower peripheral extension 26*a* is received under upper peripheral extension 25*a* of an adjacent mat; similarly, when two mats are placed together in longitudinal fashion, lower peripheral extension 26*b* of one mat is received under upper peripheral extension 25*b* of an adjacent mat.

Still referring to FIG. 3, a plurality of raised traction promoting elements 23*a* are disposed on generally planar work surface 23. In the preferred embodiment, said raised traction promoting elements are positioned proximate to and in general alignment with underlying cell forming walls. A plurality of holes 29 extend through mat 20 to receive bolts or other fastening devices to affix upper half-piece 21 to mirror image lower half-piece 22. In the preferred embodiment, holes 29 have recessed ledges to permit said fastening means to be positioned below generally planar work surface 23 in order to avoid any obstruction to traffic utilizing said work surface. Further, a plurality of recessed receptacles 30 are disposed along peripheral edges. Chamfered edge 28 extends around lower half-piece 22. Although obstructed from view in FIG. 4, chamfered edge 27 extends around upper half-piece 22.

Figure 5:
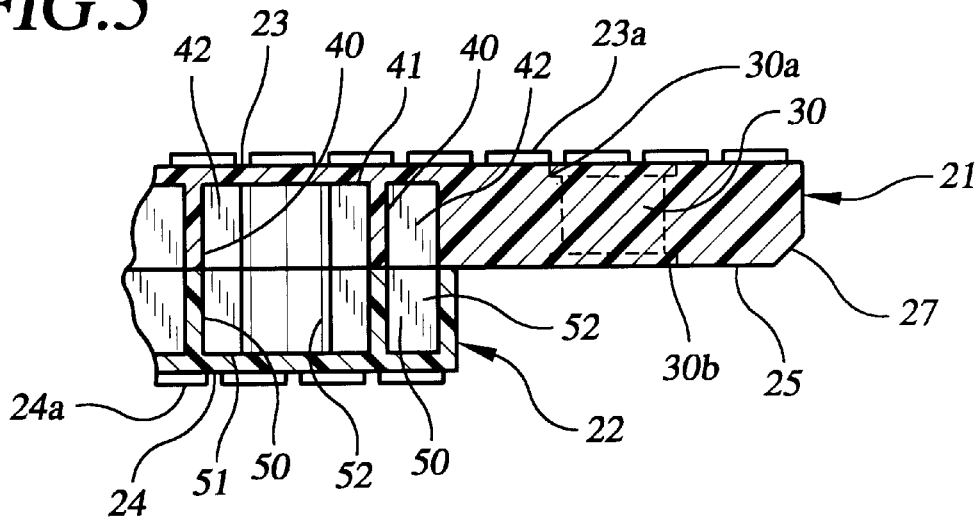
FIG. 5 depicts a cross-sectional cut-away view of an individual mat of the present invention along line 5—5 of FIG. 3.

Referring to FIG. 5, which is a cross-sectional cut-away along line 5—5 of FIG. 3, upper half-piece 21 is affixed to lower half-piece 22, thereby defining upper peripheral extension 25. Upper half-piece 21 has chamfered edge 27. Traction promoting raised elements 23*a* are disposed on generally planar work surface 23 of upper half-piece 21, while traction promoting raised elements 24*a* are disposed on generally planar work surface 24 of lower half-piece 22. Individual mat 20 has internal cellular structure defined by cells 42, which are formed by cell forming walls 40 of upper half-piece 21, being aligned with cells 52, which are in turn formed by cell forming walls 50 of lower half-piece 22. Roughly continuous skin 41 is integrally attached to the upper surface of cell forming walls 40, while roughly continuous skin 51 is integrally attached to the lower surface of cell forming walls 50. One surface of roughly continuous skin 41 defines generally planar work surface 23 of upper half-piece 21, while the other surface of said roughly continuous skin 41 defines a closure for cells 42. Similarly, one surface of roughly continuous skin 51 defines generally planar work surface 24 of lower half-piece 22, while the other surface of roughly continuous skin 51 defines a closure for cells 52. Recessed receptacle 30 having upper recessed ledge 30*a* and lower recessed 30*b* ledge extends through upper peripheral extension 25.

Figure 6:
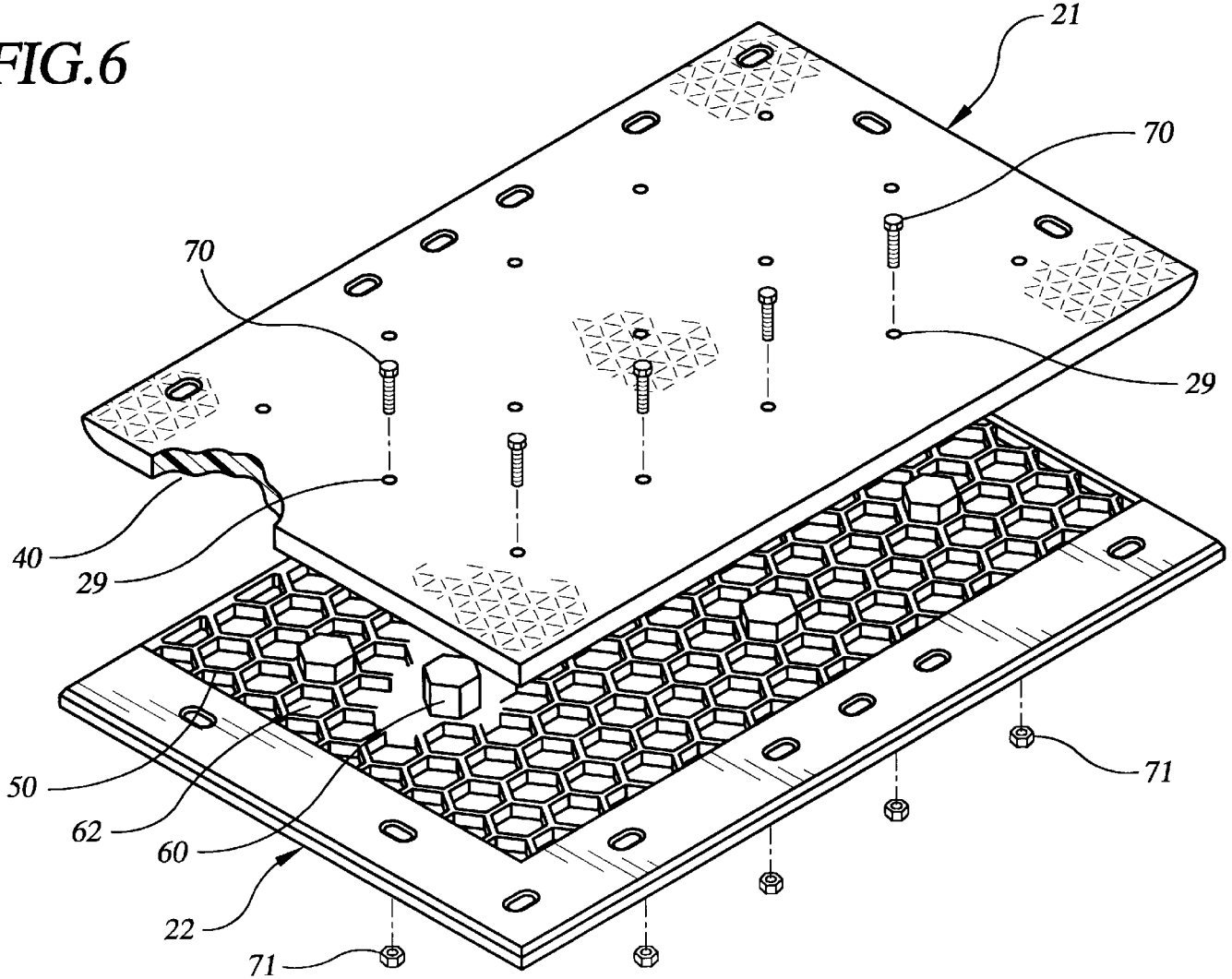
FIG. 6 depicts an exploded perspective view of two mirror-image half-pieces which together form a single mat of the present invention.

FIG. 6 depicts an exploded perspective view of mat 20 of the present invention. Upper half-piece 21 and lower half-piece 22 are mirror images of one another, and are affixed together to form individual mat 20. Area of open faced cellular structure of upper half-piece 21 is aligned with like area of open faced cellular structure of lower half-piece 22. In the preferred embodiment, the open faced cellular structure of half-piece 21 is in the shape of hexagonal honeycombs which are formed by interconnected cell forming walls 40, while the open faced cellular structure of half-piece 22 is in the shape of hexagonal honeycombs 52 which are formed by interconnected cell forming walls 50. Bolts 70 pass through recessed holes 29 of mat 20. Nuts 71 are screwed onto bolts 70 to join upper half-piece 21 to lower half-piece 22.

Figure 9:
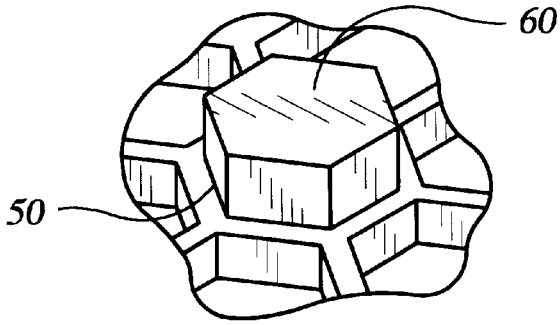
FIG. 9 depicts a hexagonal insert positioned within a hexagonal honeycomb of a half-piece of the present invention.

Rigid inserts 60 are received within said internal cellular structure of mat 20. In the preferred embodiment, rigid inserts 60 are in the shape of hexagonal inserts which are partially received within hexagonal honeycombs 42 of upper half-piece 21 and opposing hexagonal honeycombs 52 of lower half-piece 22. FIG. 9 depicts rigid insert 60 received within a hexagonal honeycomb 52 of lower half-piece 22 of the present invention. Said rigid insert 60 extends above the upper surface of cell forming walls 50 of lower half-piece 22, such that when a mirror image upper half-piece 21 is mated with and affixed to lower half-piece 22, rigid insert 60 will also be partially received within hexagonal honeycomb 42 of upper half-piece 21.

Figure 7:
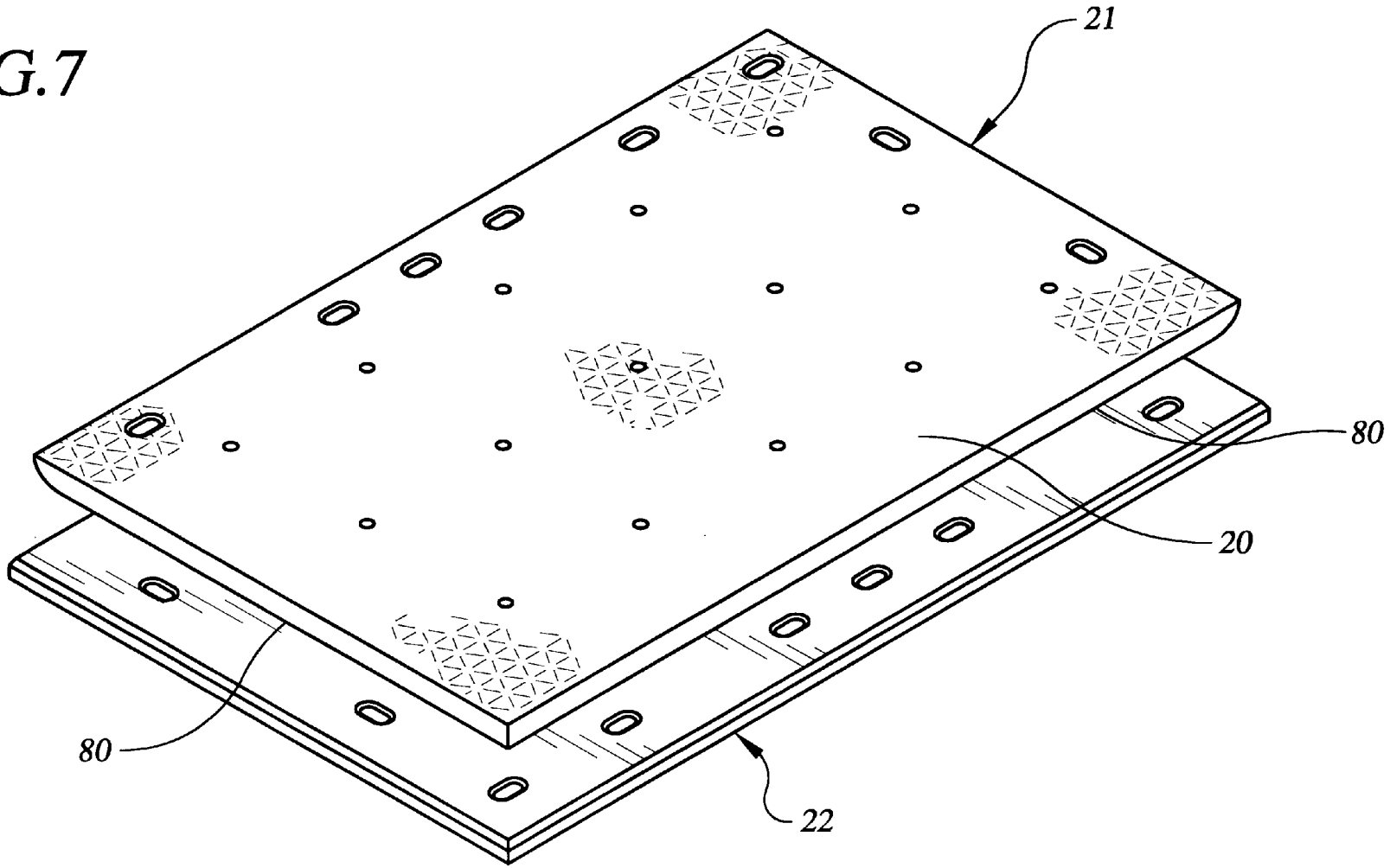
FIG. 7 depicts a perspective view of a single mat of the present invention.

FIG. 7 depicts a perspective view of an individual mat 20 of the present invention, formed by joining mirror image upper half-piece 21 with lower half-piece 22. Said half-pieces are affixed together with nuts 70 and bolts 71 which are received within holes 29 in mat 20. Additionally, said half-pieces can be welded together. In the preferred embodiment, seam 80 between upper half-piece 21 and lower half-piece 22 is welded together on all four sides of mat 20 using extrusion welding.

Figure 8:
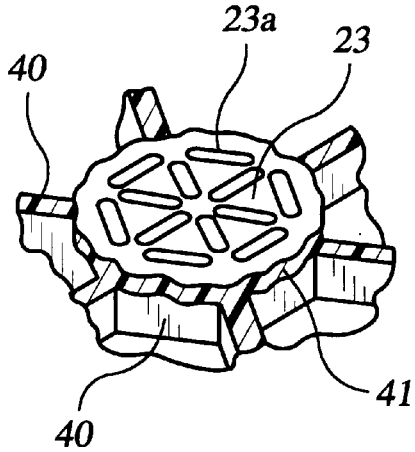
FIG. 8 depicts a cut-away view of raised traction promoting elements along the planar surface of a single mat of the present invention.

FIG. 8 depicts a cut away view of upper half-piece 21. Roughly continuous skin 41 is integrally attached to the upper surface of cell forming walls 40, and defines generally planar work surface 23. Traction promoting raised elements 23*a* are disposed on generally planar work surface 23. In the preferred embodiment, a plurality of said traction promoting raised elements 23*a* are positioned proximate to and in general alignment with underlying cell forming walls 40.

Figure 10:
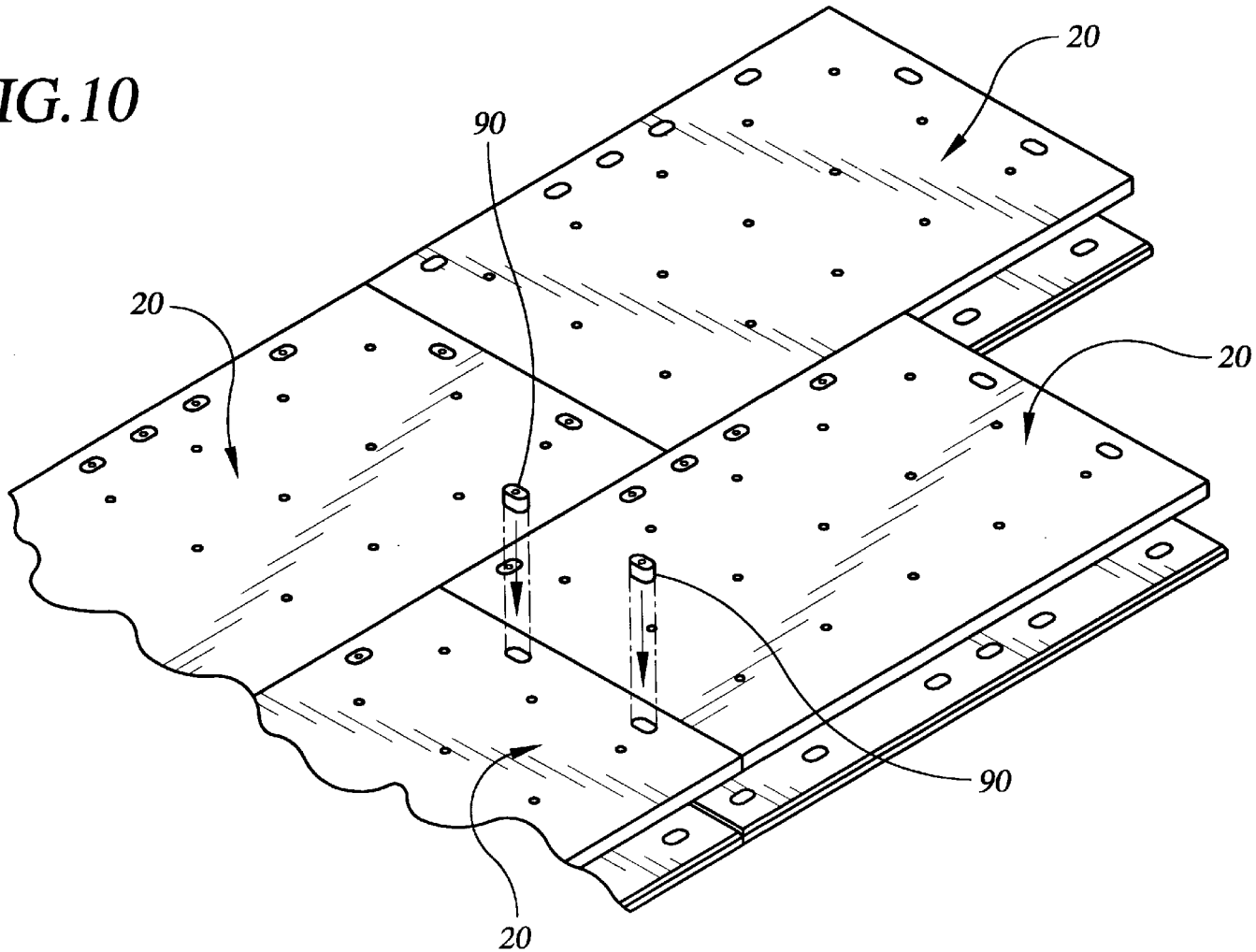
FIG. 10 depicts a perspective view of a plurality of individual mats of present invention positioned to form a load supporting surface.

FIG. 10 depicts a plurality of individual mats 20 which are laid out to form a roughly continuous equipment support surface. When a plurality of individual mats are joined together, said mats form a roughly continuous and substantially smooth roadway or other support surface. Further, the overlap/underlap relationship shared by the offset peripheral edges of adjoining mats provides strength for load support purposes. Additionally, said overlap/underlap relationship also provides increased frictional contact between mats to help prevent separation of said mats.

In many applications, frictional contact alone is sufficient to keep said individual mats in contact with one another so that gaps will not develop between said mats. However, in the preferred embodiment, a plurality of recessed slots are provided along the peripheral edges of said mats. Said recessed slots are positioned in such a manner that, when individual mats of the present invention are laid out to form a roadway or support surface, recessed slots of adjoining mats are aligned with one another. Stakes can be disposed within said slots and, if desired, driven into the underlying terrain to further anchor said mats in position. Pegs 90 or other clamping means can be inserted into said slots and used to hold the mats in place. Said slots are recessed to ensure that a stake or other clamping means, when disposed within said slots, remain recessed below the generally planar upper work surface of said mats so as not to impede or provide a hazard for traffic using a roadway or equipment support surface constructed from the mat system of the present invention.

While the mat system of the present invention can be constructed of any number of materials, in the preferred embodiment the mats disclosed herein are constructed of synthetic materials. Said composite materials could include virgin thermoplastic resins, as well as re-claimed polyolefins and/or vulcanized rubber, as well as any number of additives which can improve or modify the characteristics of said mats. For example, such additives could improve the frictional quality of the mats or the ability of the mats to dissipate static electricity.

Whereas the invention is herein described with respect to a preferred embodiment, it should be realized that various changes may be made without departing from essential contributions to the art made by the teachings hereof.

What is claimed is:

1. A load supporting structure comprising:

a. a first generally rectangular panel having a top, a bottom, a plurality of substantially vertical walls extending between said top and bottom which define a plurality of hollow cells, and a substantially solid lip along two adjacent sides of said panel, wherein a skin is disposed along the bottom of said substantially vertical walls to define a substantially continuous surface on the bottom of said first panel;

b. a second generally rectangular panel having a top, a bottom, a plurality of substantially vertical walls extending between said top and bottom which define a plurality of hollow cells, and a substantially solid lip along two adjacent sides of said panel, wherein a skin is disposed along the top of said substantially vertical walls to define a substantially continuous surface on the top of said second panel;

c. a plurality of raised elements extending from the lower surface of said first panel, wherein said raised elements are proximate to and in general alignment with the vertical walls of said first panel;

d. a plurality of raised elements extending from the upper surface of said second panel, wherein said raised elements are proximate to and in general alignment with the vertical walls of said second panel; and e. means for affixing the top of said first panel to the bottom of said second panel, wherein said panels are offset relative to one another such that said substantially solid lip of said first panel forms a lower peripheral extension along two adjacent sides, and said substantially solid lip of said second panel forms an upper peripheral extension along the remaining two sides, and the substantially vertical walls of said first panel are aligned with said substantially vertical walls of said second panel.

2. The load supporting structure recited in claim 1, wherein said means for affixing said first panel to said second panel comprises a plurality of mechanical fasteners.

3. The load supporting structure recited in claim 2, wherein said mechanical fasteners further comprise:

a. a plurality of threaded bolts disposed through bores extending through said first and second panels; and b. nuts received on said threaded bolts.

4. The load supporting structure recited in claim 1, wherein said first and second panels are welded along the seam formed between said first and second panels.

5. The load supporting structure recited in claim 1, further comprising a traction promoting material on the bottom of said first panel and the top of said second panel.

6. The load supporting structure recited in claim 5, wherein said traction promoting material on the bottom of said first panel and top of said second panel comprises low density polyethylene.

7. The load supporting structure recited in claim 1, further comprising means for dissipating static electricity.

8. The load supporting structure recited in claim 1, further comprising a plurality of bores extending through said substantially solid lip of said first panel and said substantially solid lip of said second panel.

* * * * *